US012168980B2

(12) United States Patent
Klassen et al.

(10) Patent No.: US 12,168,980 B2
(45) Date of Patent: Dec. 17, 2024

(54) HYPOTROCHOID POSITIVE-DISPLACEMENT MACHINE

(71) Applicant: Genesis Advanced Technology Inc., Surrey (CA)

(72) Inventors: James B. Klassen, Osoyoos (CA); Javier Peter Fernandez-Han, Burnaby (CA); Kellen Devries, Surrey (CA)

(73) Assignee: Genesis Advanced Technology Inc., Surrey (CA)

( * ) Notice: Subject to any disclaimer, the term of this patent is extended or adjusted under 35 U.S.C. 154(b) by 0 days.

(21) Appl. No.: 18/304,256

(22) Filed: Apr. 20, 2023

(65) Prior Publication Data

US 2024/0352929 A1 Oct. 24, 2024

(51) Int. Cl.
*F04C 2/10* (2006.01)
*F04C 15/00* (2006.01)

(52) U.S. Cl.
CPC ..... *F04C 2/10* (2013.01); *F04C 15/00* (2013.01); *F04C 15/0019* (2013.01); *F04C 2240/20* (2013.01); *F04C 2250/20* (2013.01)

(58) Field of Classification Search
CPC ..... F04C 2/084; F04C 2/088; F04C 2/10; F04C 15/0019; F04C 2210/1094; F04C 2210/20; F04C 2210/206; F04C 2210/224; F04C 2240/20; F04C 2250/20; F05C 2225/04
See application file for complete search history.

(56) References Cited

U.S. PATENT DOCUMENTS 2,389,728 A 11/1945 Hill
3,117,561 A 1/1964 Bonavera
3,758,243 A 9/1973 Fox, Jr.
3,887,311 A 6/1975 Louzecky
(Continued)

FOREIGN PATENT DOCUMENTS

CN 2606814 Y * 3/2004
CN 204145111 U * 2/2015
(Continued)

OTHER PUBLICATIONS

CN-2606814Y-Gao et al.—A Flexible Inner Engage an Outer Vane Type Gear Pump—Mar. 17, 2004—the English Machine Translation (Year: 2004).*
CN-204145111U b-Huang et al.—Damping Rotor and Motor Equipped with the Same—Feb. 4, 2015—the English Machine Translation (Year: 2015).*
(Continued)

*Primary Examiner* — Theresa Trieu
(74) *Attorney, Agent, or Firm* — Seed IP Law Group LLP

(57) ABSTRACT

A hypotrochoid positive-displacement machine includes an inner rotor and an outer rotor with intermeshing projections. During rotation of the rotors, the inward-most tips of the outer rotor trace hypotrochoid paths relative to the inner rotor. A driven rotor, for example the inner rotor, drives a driven rotor, for example the outer rotor, by contact between driving surfaces and driven surfaces of the respective rotors. Improvements are provided, for example in relation to the contact between the rotors. In use of the device contact between the driving surfaces and driven surfaces may move radially outward from a point of initial contact. The driving or driven surfaces or both may be arranged to flex under contact between the rotors. The driving surfaces may be convex. The driven surfaces may be concave.

22 Claims, 18 Drawing Sheets

(56) References Cited

U.S. PATENT DOCUMENTS

| | | | | |
|---|---|---|---|---|
| 4,100,664 | A | 7/1978 | Straesser | |
| 4,932,850 | A * | 6/1990 | Valavaara | F04C 2/102 418/171 |
| 5,066,207 | A * | 11/1991 | Valavaara | F04C 2/102 418/171 |
| 5,505,668 | A | 4/1996 | Koriakov-Savoysky et al. | |
| 5,720,251 | A * | 2/1998 | Round | F04C 2/102 418/171 |
| 5,820,504 | A * | 10/1998 | Geralde | F16H 1/32 475/180 |
| 6,089,843 | A * | 7/2000 | Kondoh | F04C 2/102 418/171 |
| 6,273,695 | B1 | 8/2001 | Arbogast et al. | |
| 6,893,239 | B2 | 5/2005 | Pippes | |
| 9,127,671 | B2 | 9/2015 | Ono et al. | |
| 9,670,924 | B2 | 6/2017 | Holtzapple et al. | |
| 11,549,507 | B2 | 1/2023 | Klassen et al. | |
| 2005/0063851 | A1 | 3/2005 | Phillips | |
| 2012/0248903 | A1 | 10/2012 | Cullen et al. | |
| 2014/0299094 | A1 | 10/2014 | Li | |
| 2017/0370359 | A1 | 12/2017 | Kimura et al. | |
| 2018/0172000 | A1 | 6/2018 | Hattori et al. | |

FOREIGN PATENT DOCUMENTS

| | | | |
|---|---|---|---|
| CN | 212690750 U | * | 3/2021 |
| DE | 41 04 397 A1 | | 9/1991 |
| DE | 10 2012 214 243 A1 | | 2/2014 |
| EP | 0 661 454 A1 | | 7/1995 |
| EP | 1 493 926 A2 | | 1/2005 |
| JP | 6481399 B2 | | 3/2019 |

OTHER PUBLICATIONS

CN-212690750U—Chen—Inner Gear Ring with High Stability—Mar. 12, 2021—the English Machine Translation (Year: 2021 ).*

Thomas A Xometry Company, All About Internal Gear Pump—What They Are and How They Work, Article downloaded on Jul. 8, 2021 from Insights. URL=https://www.thomasnet.com/articles/pumps-valves-accessories/internal-gear-pumps; pp. 1-4

Gupta, A. et al.: Wankel Rotary Engine's Apex Seal/Trochoid Wear Chatter"the Devil's Nail Marks Persis"; International Journal of Scientific and Research Publications, 9(4): 2250-3153; Apr. 2019; 6 pages.

Warren, S., "New Rotary Engine Designs by Deviation Functions Method," UCLA Electronic These and Dessertations, University of California, Los Angeles, 2012, 138 pages.

* cited by examiner

HYPOTROCHOID POSITIVE-DISPLACEMENT MACHINE

BACKGROUND

Technical Field

Internal gear fluid transfer devices.

Description of the Related Art

Improvements are desired in internal gear fluid transfer devices. An example of a previous device is disclosed in U.S. Pat. No. 11,549,507.

BRIEF SUMMARY

An embodiment of a displacement device is disclosed. The displacement device includes a housing, an inner rotor with an inner rotor projection number of outward-facing projections and an outer rotor with an outer rotor projection number of inward-facing projections, the inner rotor being fixed for rotation relative to the housing about a first axis and the outer rotor being fixed for rotation relative to the housing about a second axis parallel to and offset from the first axis. The inward-facing projections of the outer rotor have inward-most tips defining, during rotation of the rotors, hypotrochoid paths relative to the inner rotor. The inner rotor has tip sealing zones at tips of the outward-facing projections, arranged to seal against inward-most tips of the projections of the outer rotor as the inward-most tips trace the hypotrochoid paths. The inward-facing projections of the outer rotor intermesh with the outward-facing projections of the inner rotor to fix a relative ratio of rotation speeds defined by a ratio of the inner rotor projection number to the outer rotor projection number. As they intermesh, driving surfaces of the projections of one rotor, for example driving surfaces of the outward-facing projections of the inner rotor, contact corresponding driven surfaces of the projections of the other rotor, for example, driven surfaces of the inward-facing projections of the outer rotor.

In various embodiments, there may be included any one or more of the following features: in use of the displacement device contact between the driving surfaces and corresponding driven surfaces move radially outward from a point of initial contact; the driving surfaces or corresponding driven surfaces or both are arranged to flex under contact between the rotors; the inner rotor lobes are formed of steel and the outer rotor fins are formed of a flexible material having an elastic modulus of, for example, less than 150 GPa, or less than an elastic modulus of the steel of the inner rotor lobes; the driving surfaces are formed at least in part on driving surface flexible zones; the driven surfaces are formed at least in part on driven surface flexible zones; the driven surface flexible zones each define at least in part a slot in a respective inward-facing projection of the outer rotor; the driven surface flexible zones are each separated from the inward-most tip of the respective inward-facing projection of the outer rotor by the slot in the respective inward-facing projection of the outer rotor; the slot in the respective inward-facing projection of the outer rotor extends from a leading face of the respective inward-facing projection of the outer rotor so that the driven surface flexible zones include the inward-most tips of the respective inward-facing projection of the outer rotor as well as at least a portion of the driven surface of the respective inward-facing projection of the outer rotor; the inward-facing projections of the outer rotor comprise damping material; the inward-facing projections of the outer rotor are connected to a main body of the outer rotor using fasteners; the inward-most tips of the inward-facing projections of the outer rotor are rounded; the inner rotor further comprises trough scaling zones at troughs between the outward-facing projections, the trough sealing zones being arranged to seal against the inward-most tips of the projections of the outer rotor as the inward-most tips trace the hypotrochoid paths; the inward-most tips are constructed from a harder material than the trough sealing zones; the inward-most tips are configured to abrade the trough sealing zones; the inward-most tips are formed of a softer material than the trough sealing zones; the inward-most tips are configured to be abraded by the trough sealing zones; the trough sealing zones are configured to abrade the inward-most tips; the inward-most tips are formed of a softer material than the tip sealing zones; the tip sealing zones are configured to abrade the inward-most tips; the inward-most tips are formed of a harder material than the tip sealing zones; the inward-most tips are configured to abrade the tip sealing zones; the corresponding driven surfaces of the outer rotor are concave; the driving surfaces of the inner rotor are convex; and the inner rotor, outer rotor or both define flow channels arranged to prevent the formation of a sealed secondary chamber between the outward-facing projections of the inner rotor and the inward-facing projections of the outer rotor at or near Top Dead Center (TDC).

BRIEF DESCRIPTION OF THE SEVERAL VIEWS OF THE DRAWINGS

Embodiments will now be described with reference to the figures, in which like reference characters denote like elements, by way of example, and in which.

DETAILED DESCRIPTION

Immaterial modifications may be made to the embodiments described here without departing from what is covered by the claims.

Seals or the act of scaling in this disclosure may, at times, refer to the interaction of parts which are in proximity to one another to a sufficient degree to limit undue flow of a fluid through a gap between the parts. Such seals or sealing may be present when the parts contact or may also be present when the parts are in close physical proximity to one another, but there is no physical contact between the parts. Such interactions may alternatively be referred to as contact or near contact seals.

In this document the inward-facing projections of the outer rotor may also be referred to as "fins" and the outward-facing projections of the inner rotor may also be referred to as "lobes." The use of these terms should not be taken to exclude different geometries where applicable. In some embodiments, the fins may be flexible. In some embodiments, the driving surfaces or corresponding driven surfaces are both arranged to flex under contact between the rotors.

Figure 1:
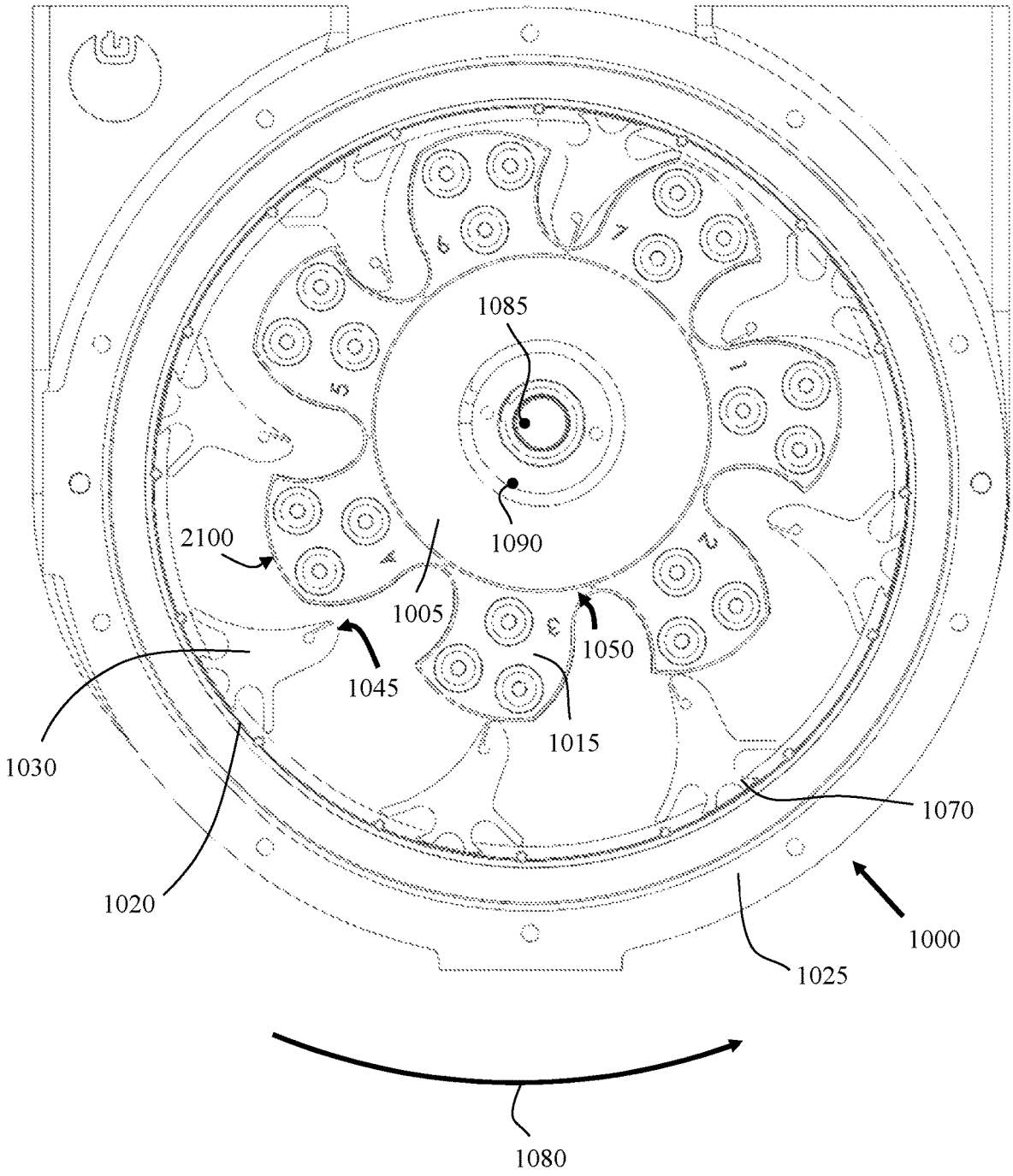
FIG. 1 is an axial view of an exemplary displacement device.
Figure 2:
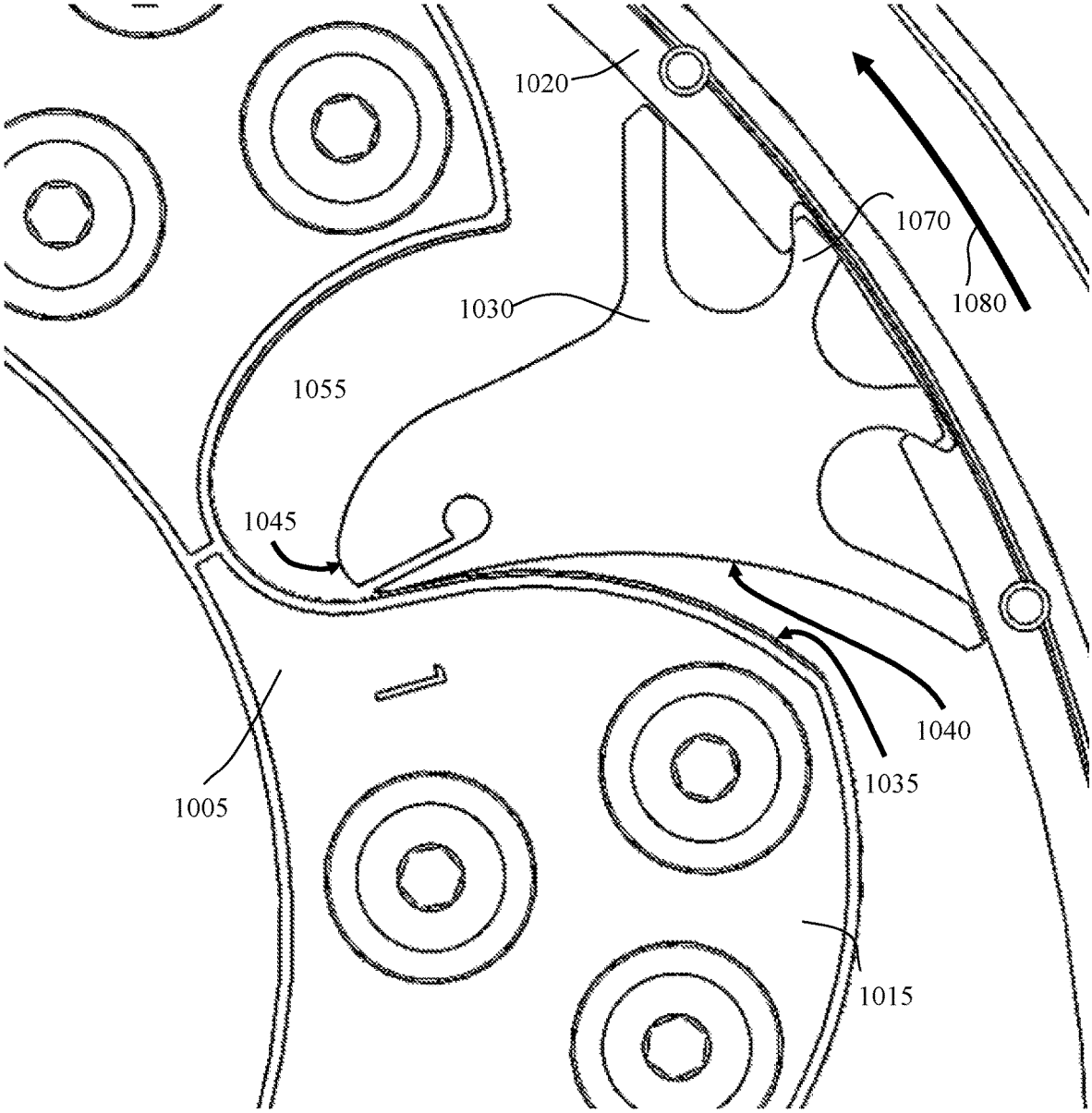
FIG. 2 is a close-up of FIG. 1 showing contact of the driving surface of the inner rotor with the driven surface of the outer rotor.

In an embodiment shown in FIG. 1 and FIG. 2, a positive displacement device 1000 comprises a housing 1025, an inner rotor 1005 with an inner rotor projection number of outward-facing projections 1015, the inner rotor 1005 being fixed for rotation relative to the housing 1025 about a first axis 1085, an outer rotor 1020 with an outer rotor projection number of inward-facing projections 1030, the outer rotor 1020 being fixed for rotation relative to the housing about a second axis 1090 parallel to and offset from the first axis, the inward-facing projections 1030 of the outer rotor 1020 having inward-most tips 1045 defining, during rotation of the rotors, hypotrochoid paths relative to the inner rotor 1005, the aforementioned inner rotor 1005 comprising tip sealing zones 2100 at tips of the outward-facing projections, the aforementioned tip sealing zones 2100 being arranged to seal against inward-most tips 1045 of the projections 1030 of the outer rotor 1020 as the inward-most tips 1045 trace the hypotrochoid paths. The outward-facing projections 1015 of the inner rotor 1005 and the inward-facing 1030 projections of the outer rotor 1020 intermesh. In an embodiment, driving surfaces 1035 of the outward-facing projections of the inner rotor contacting corresponding driven surfaces 1040 of the inward-facing projections of the outer rotor as the projections intermesh to fix a relative ratio of rotation speeds defined by a ratio of the inner rotor projection number to the outer rotor projection number. In a further embodiment, in use of the displacement device contact between the driving surfaces and corresponding driven surfaces may move radially outward from a point of initial contact.

Figure 9:
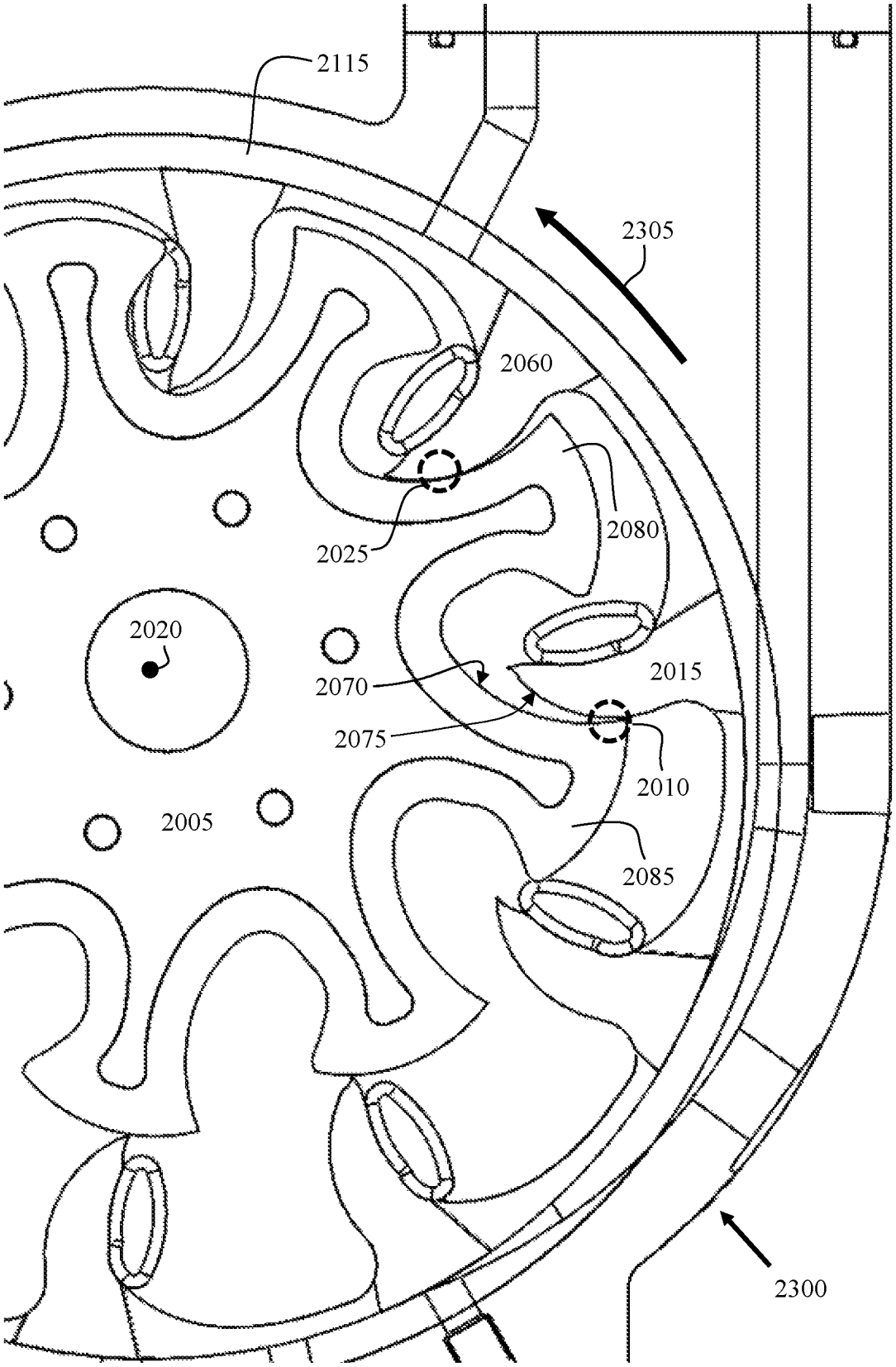
FIG. 9 (PRIOR ART)
FIG. 9 shows a prior art geometry for comparison.

FIG. 9 shows a geometry of prior art disclosed in U.S. Pat. No. 11,549,507. In this figure, the direction of rotation of the inner rotor 2005 and outer rotor 2115 of machine 2300 is shown by arrow 2305. Driving contact between the driving surfaces 2070 of the inner rotor and the corresponding driven surfaces 2075 of the outer rotor starts at point 2010 and ends at point 2025. Thus, as the rotors rotate together, this driving contact moves from an initial point to a point which is radially closer to the rotational axis of rotation of the inner rotor.

Figure 10:
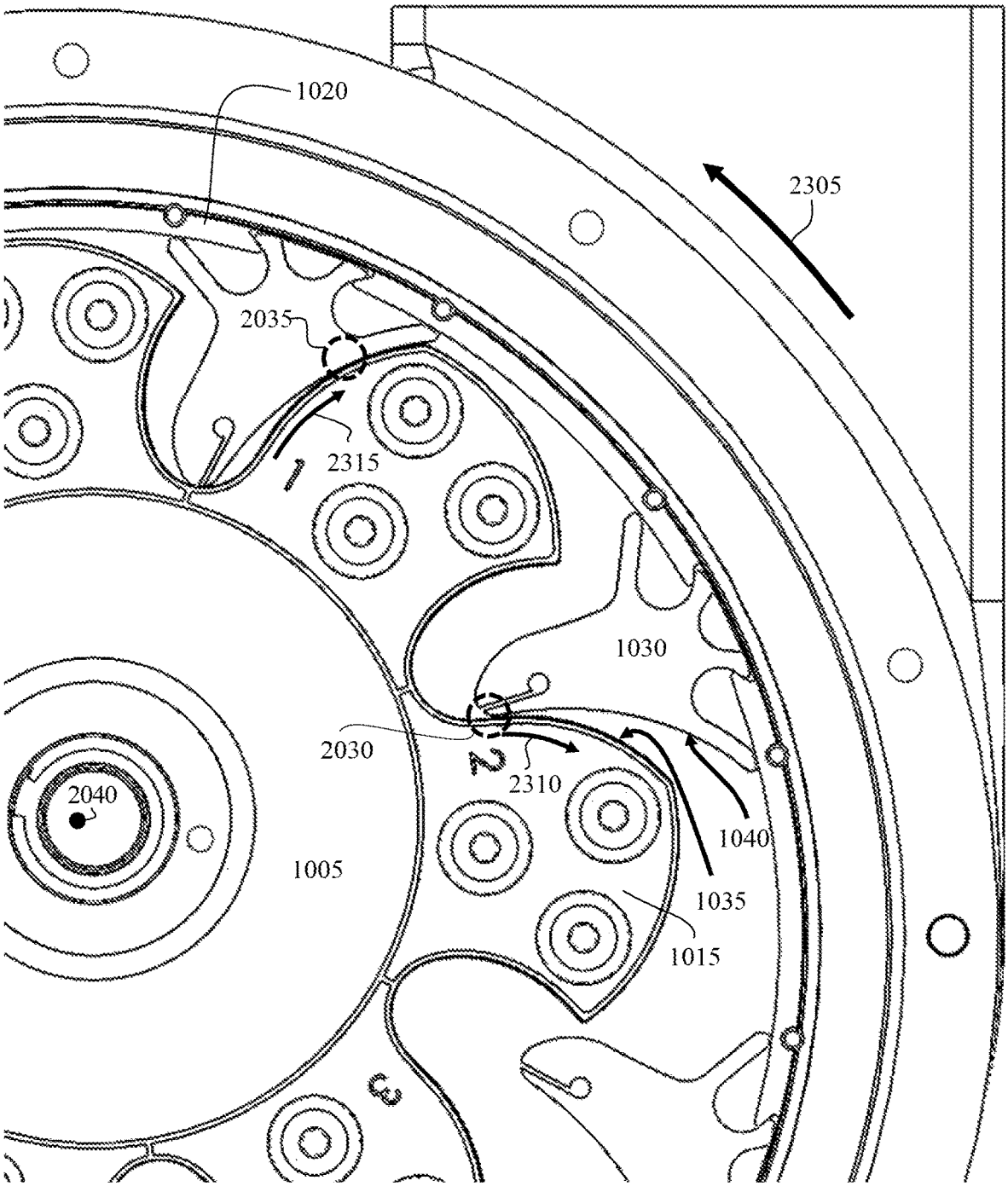
FIG. 10 shows a view of a novel displacement device with an end plate and an axial cover removed for clarity.

In contrast, in the geometry of the novel device disclosed in this document and shown for example in FIG. 10, the initial point of contact between the driving surfaces 1035 of the inner rotor 1005 and the corresponding driven surfaces 1040 of the outer rotor 1020 takes place at a point of initial contact 2030 near the inner-most ends of the outer rotor fins 1030 and moves outward over time as shown by later point of contact 2035. For reference, the direction of rotation of the inner and outer rotor is shown by arrow 2305. As the rotors rotate together, the contact moves radially away from the rotational axis, as shown by arrows 2310 and 2315. This has the benefit of promoting deflection of the outer rotor fins at the point of initial engagement between the rotors at point 2030 because the inner rotor has the potential to exert a higher force on the driven surfaces of the outer rotor at a position closer to the rotation axis of the inner rotor 1085 for a given input torque, and a force exerted on the fins result in greater deflection of the outer rotor fins when exerted closer to the axis of rotation of the outer rotor 1090. These two aspects allow for variation in the positioning of the inward-facing outer rotor projections relative to the inner rotor outward projections at the point of initial contact 2030 between the inner rotor and the outer rotor and is expected to result in smooth engagement between the inner and outer rotor as the inner rotor drives the outer rotor.

The direction of rotation of the inner and outer rotor is shown by arrow 1080.

In another embodiment, the outer rotor can be the driving rotor and the inner rotor can be driven with different effects.

In an embodiment, the driving surfaces or corresponding driven surfaces or both may be arranged to flex under contact between the rotors.

For example, the inward-facing projection fins 1030 of the outer rotor 1020 may be formed of a flexible material. Suitable flexible materials may include but are not limited to materials with an elastic modulus of less than the elastic modulus of the inner rotor. In an embodiment, the material of the inner rotor is stainless steel which has a modulus of elasticity of about 180 GPa, and the material of the outer rotor fins is less than 180 GPa such as nickel, less than 150 GPa such as some high-stiffness carbon-fiber reinforced composites and grey cast iron, less than 100 GPa such as aluminum, less than 50 GPa such as plastics including PEEK, Torlon, Delrin, Nylon. In an embodiment, the inner rotor lobes are made from steel with an elastic modulus of about 180 GPa and the outer rotor fins are made from a plastic with an elastic modulus of less than 150 GPa to result in a machine with outer rotor fins which are more flexible than the inner rotor lobes.

In an embodiment, which may be combined with or separate from the above-described embodiment in which the fins are formed of a flexible material, the driving surfaces, for example of the lobes, or the corresponding driven surfaces, for example of the fins or both may be formed on flexible zones. The flexible zones render part or all of the fin or lobe more flexible in an area of contact with the inner rotor. Where the driving surfaces are formed at least in part on flexible zones, the zones may be referred to as driving surface flexible zones, and where the driven surfaces are formed at least in part on flexible zones, the zones may be referred to as driven surface flexible zones.

Figure 3:
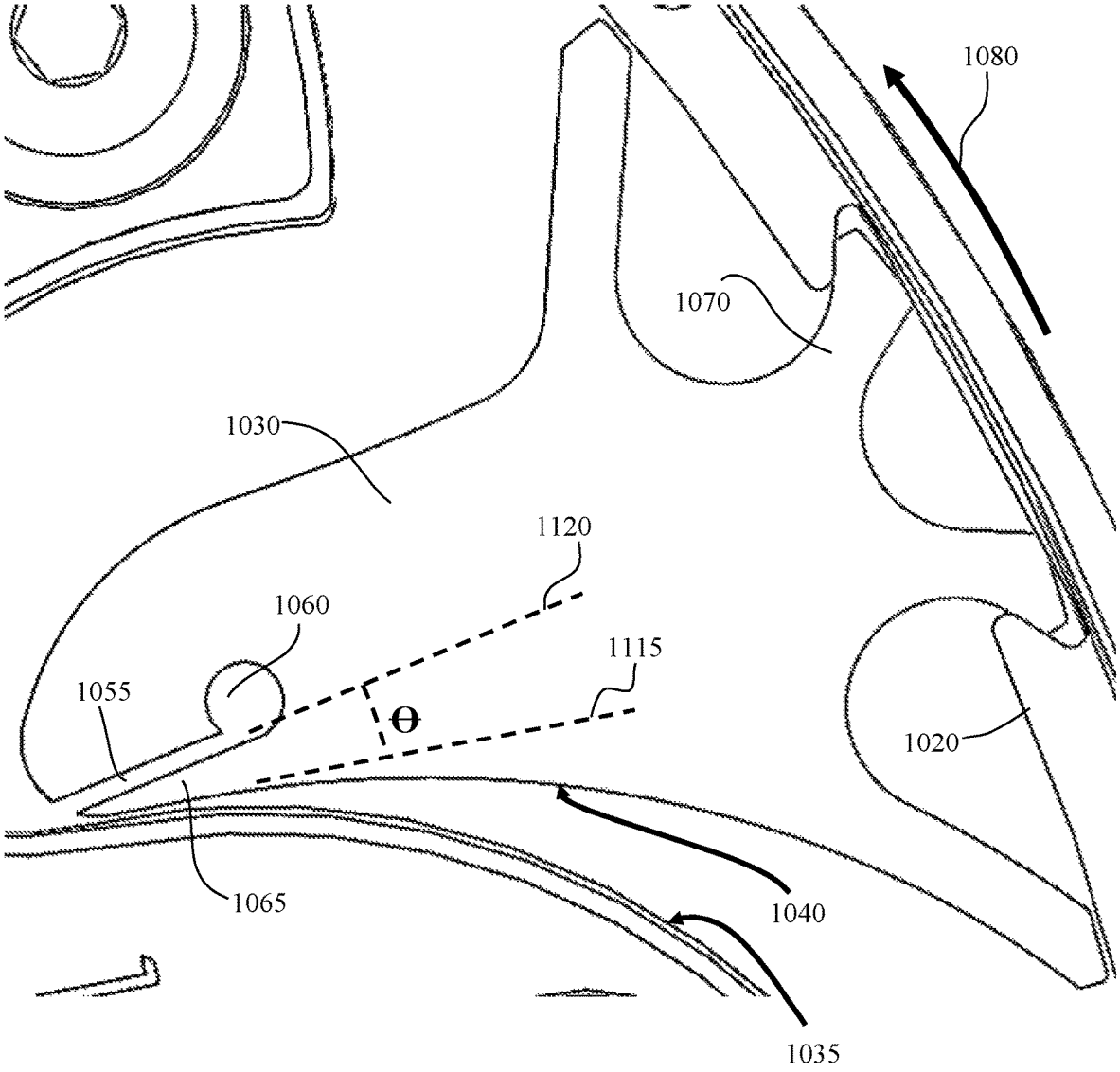
FIG. 3 is a close-up of FIG. 2 showing the driving surface of the inner rotor and the driven surface of the outer rotor as well as the angle of a slot in a fin relative to a reference line drawn tangent to the curved trailing surface of the fin.

In the embodiment shown in FIG. 3, fin 1030 features flexible zone 1065. At the rotational position of the inner and outer rotor shown in FIG. 3, the concave trailing surface 1040 of fin 1030 is moving into contact with the convex leading surface 1035 of the inner rotor. The initial point of driving contact between the inner rotor and the outer rotor occurs at a point along the flexible zone 1065 of the outer rotor fin. As the inner rotor's driving surface acts on and applies force to the flexible zone 1065 of the outer rotor fin, the flexible zone deflects.

This has the benefit of allowing the driven surfaces at the flexible zones of the outer rotor fins to move, for example to accommodate manufacturing inaccuracies or worn or damaged driven or driving surfaces without shifting the position of the other outer rotor fins relative to the inner rotor. Shifting the rotational position between the inner and outer rotor in order to accommodate a single inner rotor and outer rotor interaction could cause interference between the other interactions between the inner and outer rotor.

Figure 11:
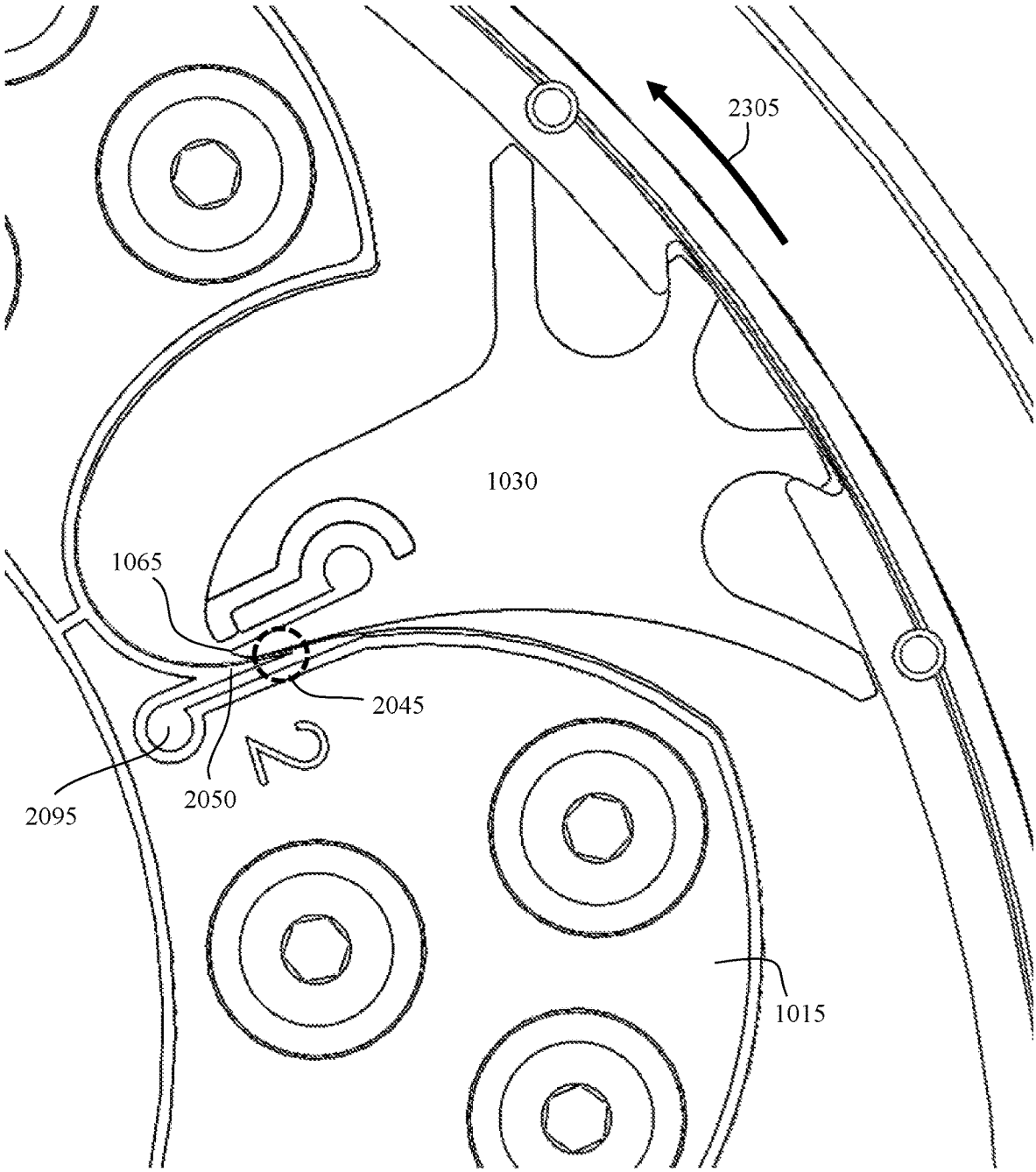
FIG. 11 shows a close-up view of an inner rotor with a flexible zone.
Figure 12:
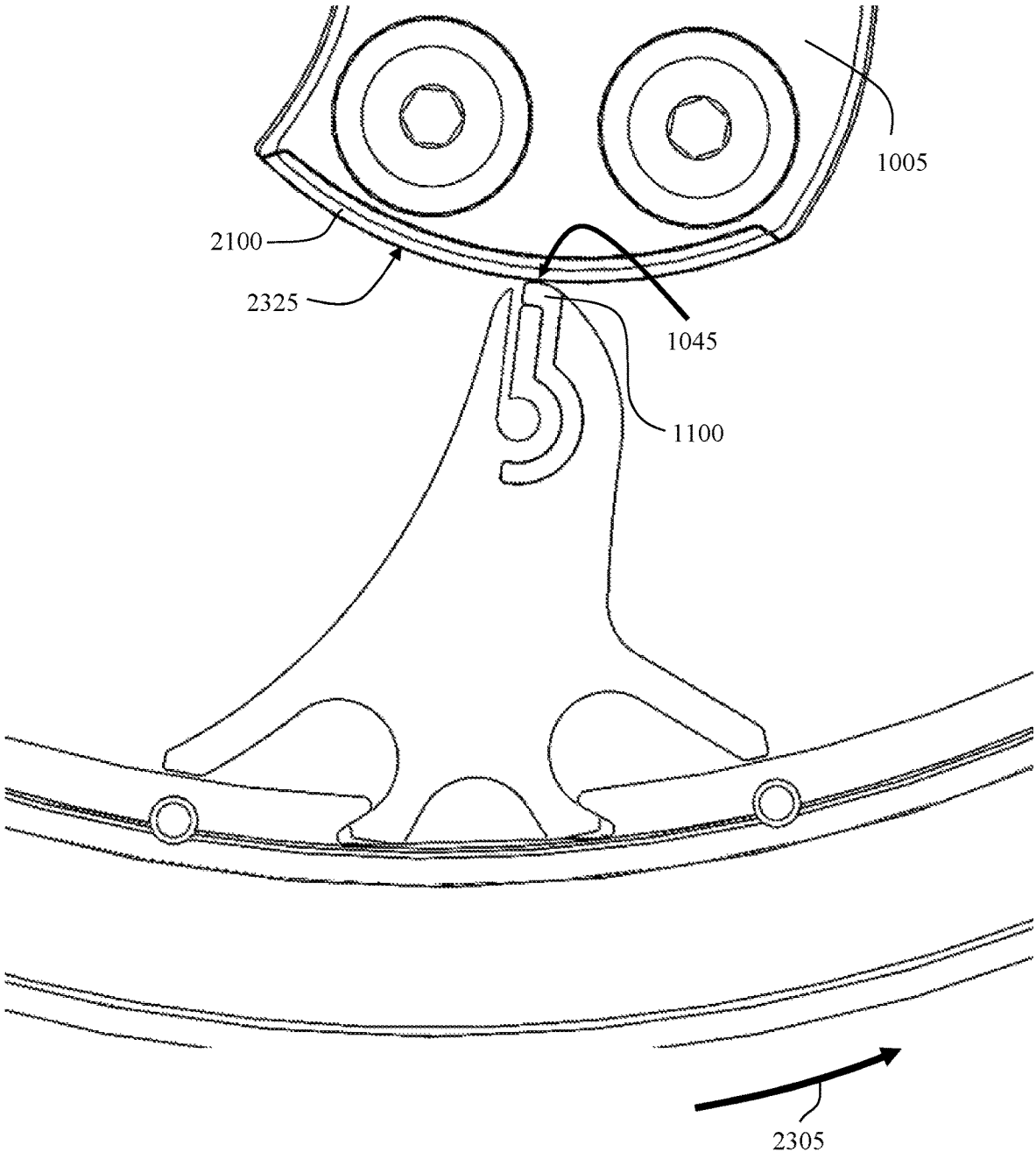
FIG. 12 shows a close-up view of an inner rotor with a discrete tip sealing zone.

In an embodiment shown in FIG. 11, an inner rotor features flexible zone 1065 and an outer rotor features flexible zone 2050. A point of contact 2045 between flexible zone 1065 and flexible zone 2050 is also shown. For reference, in FIGS. 11-14 and 16 the direction of rotation of the inner and outer rotor is shown by arrow 2305. In a further embodiment, the inner rotor may feature a flexible zone, for example as shown in FIG. 11, even if the outer rotor does not.

In an embodiment, a driven surface flexible zone may comprise at least in part a slot 1055 in a respective fin. In an embodiment of a displacement device shown in FIG. 2 in the greater context of a portion of the inner rotor for reference and in greater detail in FIG. 3, the outer rotor fin 1030 features a slot 1055. A hole 1060 in fin 1030 is tangent to the slot 1055. The inventor considers this tangential hole geometry to be advantageous as it reduces or prevents the formation of a stress concentration at the root of the flexible zone when a force is applied to the resulting flexible zone 1065 of the fin 1030. However, the inventor also contemplates that in some embodiments, this tangent hole geometry may not be necessary or possible due to material or geometrical considerations. In the embodiment shown in FIG. 3, the curved concave geometry of the driven surface 1040 of the fin 1030 has the surprising benefit of enabling a tapered geometry of a flexible zone when an appropriate angle of the slot cut into the fin is selected, resulting in even stress formation within the flexible zone during deflection and allowing for a flexibility of the flexible zone which is tunable through design. As shown in FIG. 3, the angle, theta, between the reference line 1120 parallel to the straight edges of the slot 1055 and a reference line 1115 tangent to the driven curved surface of the fin increases as the point along the driven surface moves outward from the center of the outer rotor, for the majority of the flexible zone. The flexible zone 1065 shown in FIG. 3 would exhibit varying amounts of flexibility depending on where a force is applied to the flexible zone. In the embodiment shown in FIG. 3, a force applied at a position near the radially inner-most end of the flexible zone and normal to the surface would result in more deflection of the flexible zone than the same force applied normal to the driven surface with the force applied at a position closer to the inner-most end near the root of the flexible zone. The same force applied normal to the driven surface at intermediate positions between either end of the flexible zone would exhibit gradually increasing deflection as the position of the applied force grows closer to the radially inner-most ends of the fins. This is expected to result in smooth engagement between the inner and outer rotor as the inner rotor drives the outer rotor. This geometry is also simple to manufacture via extrusion, injection molding, and via subtractive manufacturing as a drilled hole intersecting a slot cut into the fin as a few examples.

The inventor anticipates an embodiment wherein the inner rotor is driven by the outer rotor in which the same flexible zone concept is applied to the driving surfaces of the inner rotor. For example, the inner rotor may comprise flexible zones, such as a flexible zone comprising a slot in the flexible inner rotor projection. In the embodiment shown FIG. 11 inner rotor lobe 1015 features flexible zones 2050 as well as a hole 2095 which reduces or prevents the formation of a stress concentration at the root of the slot.

In any case involving a flexible zone located on a rotor, the mass, material, and thickness of the flexible zone may be tuned in order to modify the resonant frequencies of the flexible zones and or rotor, for example to avoid resonance at frequencies expected to be encountered in operation of the device.

In the embodiment shown in FIG. 3, the inward-most portion of driven surface 1040 of the outer rotor 1020 is part of the driven surface flexible zone due to slot 1055 which separates a protrusion forming flexible zone 1065 from the rest of the fin 1030 including the inward-most tips. The slot may be cut so as to keep the driven surface 1040 intact while forming a flexible zone 1065. In an embodiment, the slot may separate the driven surface flexible zones from the inward-most tips of the respective inward-facing projections of the outer rotor. In an embodiment, as shown in FIG. 3, the slot 1055 connects to a hole 1060 in the fin, for example being tangent to the hole.

Figure 4:
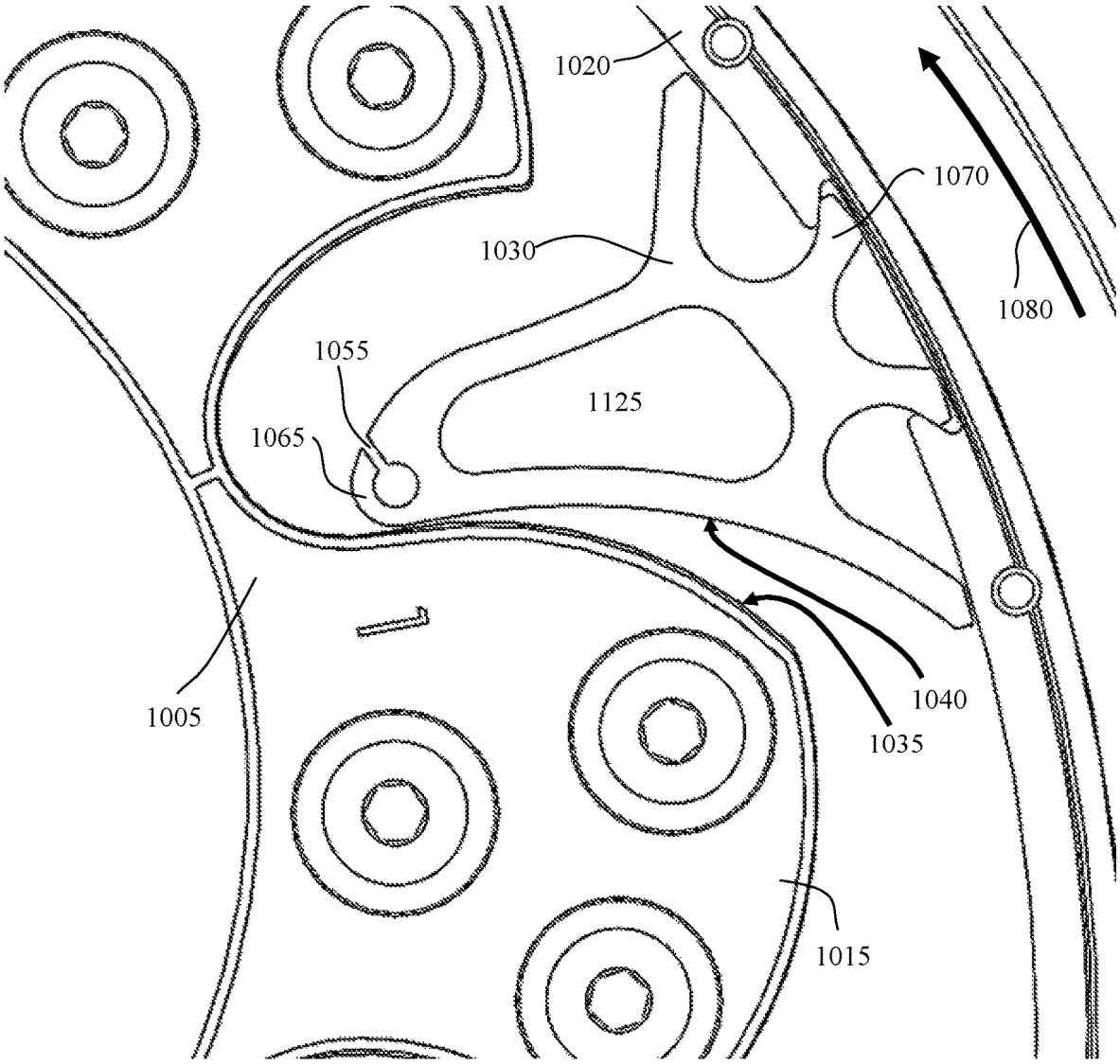
FIG. 4 is a close-up view of an alternate outer rotor fin geometry with a flexible zone at the inner-most tip of the outer rotor fin.

In an alternate embodiment shown in FIG. 4, a slot 1055 is shown extending from a leading face of the fin 1030 near the inner-most end of the outer rotor fin 1030. This forms a driven surface flexible zone 1065 along the fin 1030 which includes the radially inward-most tip of the fin 1030 as well as at least a portion of the driven surface.

In an embodiment, a displacement device may have one or more flexible zones which are located near the inward-most tips so that flexing of the one or more flexible zones allows for variation in the positioning of the inward-most tips relative to a main body of the outer rotor, but the one or more flexible zones do not include the inward-most tips.

In an embodiment, the fins are connected to a main body of the outer rotor using fasteners. In the embodiment shown in FIG. 5A, fin 1030 is fixed to outer rotor 1020 via bolt 1095. In the embodiment shown in FIG. 5A, the fins are secured to the diameter of outer rotor 1020 via bolt 1095 which screws into a securing plate 1075. The use of the securing plate is beneficial when the fin 1030 is constructed from a soft material. However, the inventor anticipates that in some embodiments the fin may also be directly bolted through the diameter of the outer rotor without the use of the plate. The inventor further anticipates that a wide variety of other methods could be used to affix the fin to the outer rotor such as but not limited to adhesive bonding, thermal fitting, press fitting, transition fitting, welding, cold welding, and or magnetic fastening.

Figure 5A:
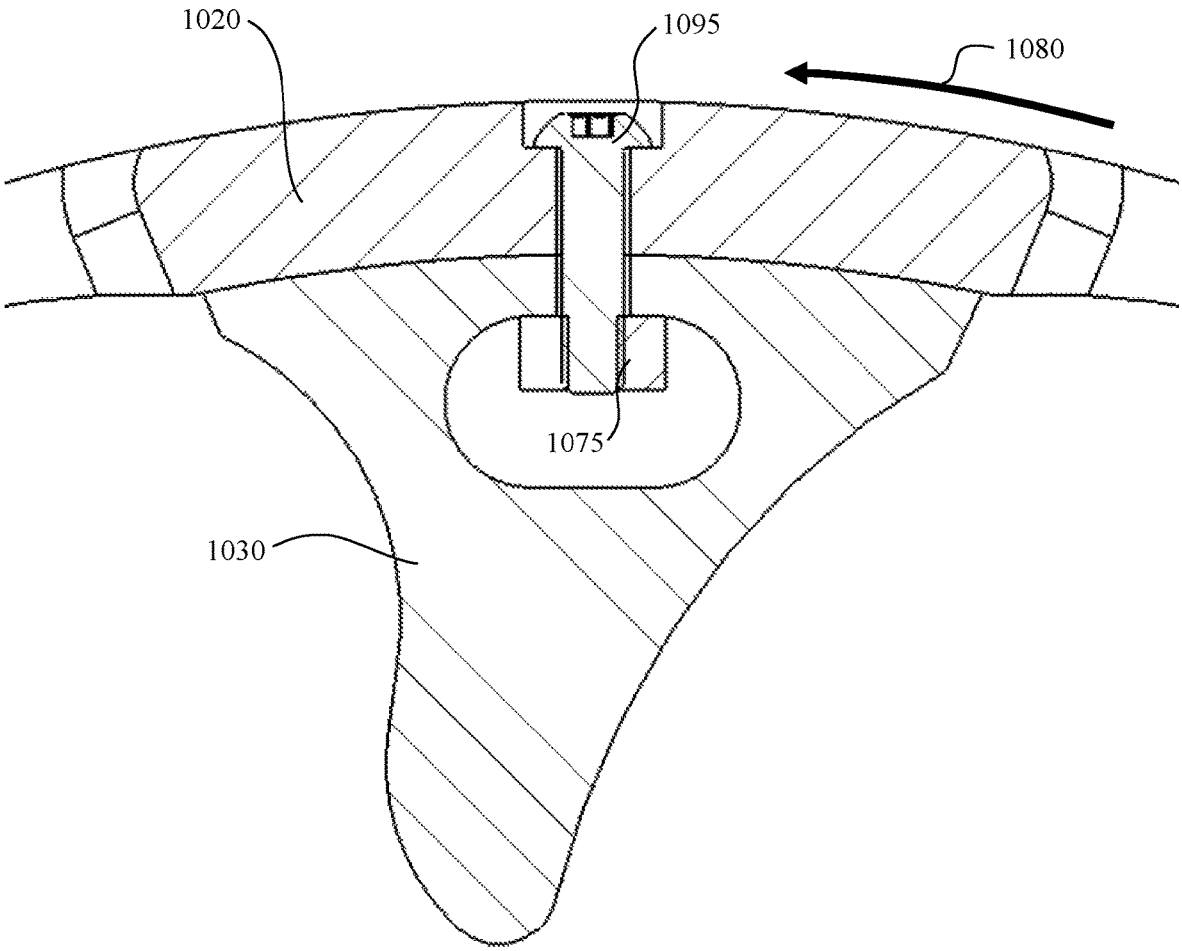
FIG. 5A is a close-up view of an outer rotor fin geometry which is bolted to the cylindrical portion of an outer rotor.
Figure 5B:
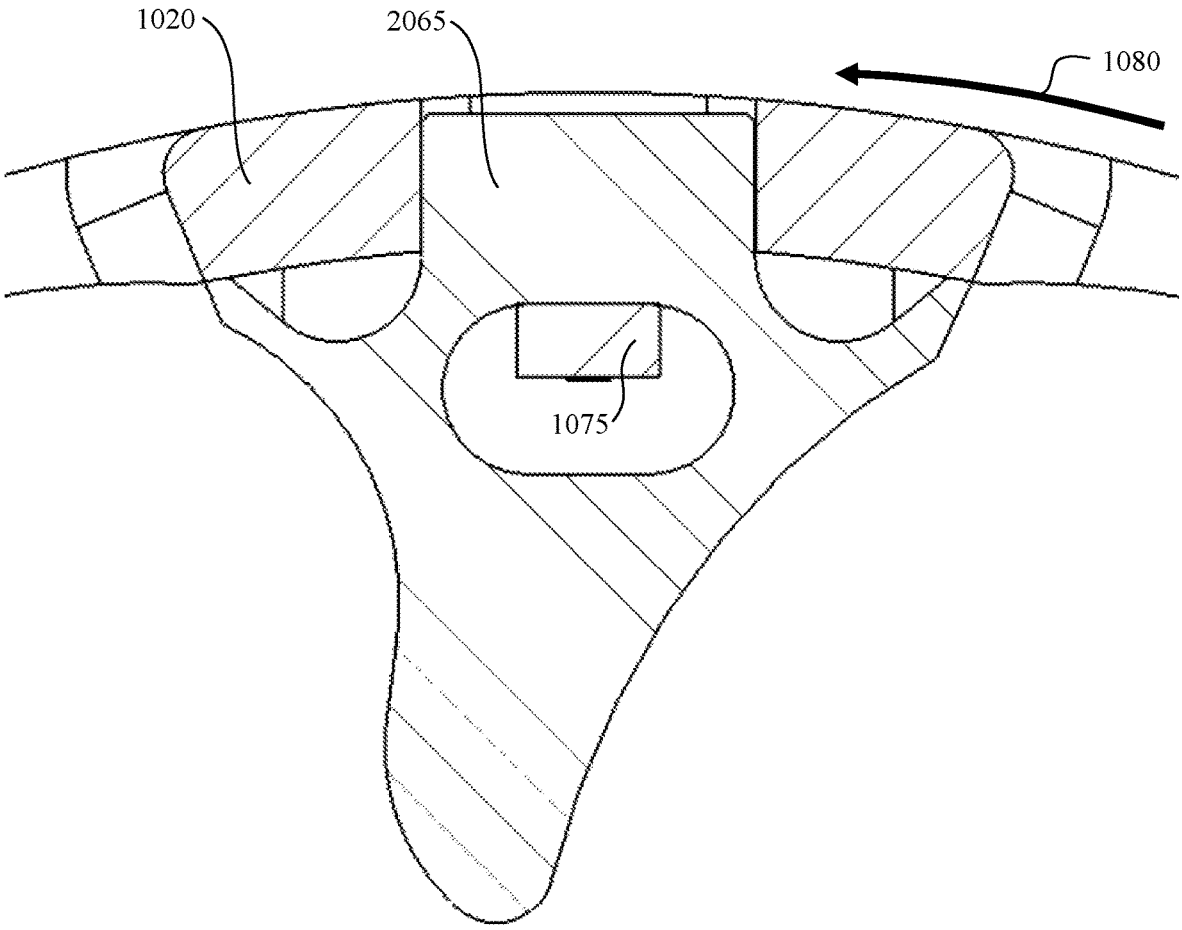
FIG. 5B is an alternate close-up view of the outer rotor fin shown in FIG. 5A showing an alignment feature.

The embodiment of the outer rotor fin shown in FIG. 5A and FIG. 5B has alignment feature 2065 which is not intersected by the bolt which secures the outer rotor fin to the cylindrical portion of the outer rotor. This saves space in the radial direction, allowing for a thin outer rotor which may reduce cost and weight. In the embodiment shown in FIG. 5B, the alignment feature 2065 is located on a plane shifted from the plane of the cross-section shown in FIG. 5A in the axial direction with respect to the axis of rotation of the cylindrical portion of the outer rotor 1020. The direction of the rotation of the outer rotor is shown by an arrow labeled by reference character 1080. The bolt is not labeled in FIG. 5B as it is mostly hidden by the alignment feature 2065 and the securing plate 1075.

The modular construction of the outer rotor and fins as separate parts opens up many manufacturing methods not compatible with a one-piece outer rotor and fin geometry. In an embodiment, the fins are manufactured via a separate process than the cylindrical portion of the outer rotor. For example, the fins may be manufactured via injection molding, extrusion, casting, 3D printing or machining as a few examples and the cylindrical portion of the outer rotor may be manufactured via extrusion, powder-sintering, machining, casting, forging, 3D printing, and or drawing as a few examples.

The fins may be designed to be replaceable, for example to replace worn or damaged fins.

In an embodiment shown in FIG. 1 to FIG. 4, the fins 1030 are designed to be assembled with an outer rotor 1020, with the inner rotor fins 1030 having a dovetail shape 1070 at the root of a fin 1030 and the outer rotor 1020 has corresponding dovetail shapes to be assembled together with the outer rotor fins 1030.

In an embodiment, the flexible fins include damping material. In an embodiment, the structure of the fins is constructed from a material with energy damping properties such as rubber, metal, silicone and/or plastic as a few examples.

In an embodiment, the outer rotor fins and or inner rotor projections feature a hollow geometry, such as outer rotor fin 1030 shown in FIG. 4, which has a hollow region 1125 filled with a damping material such as a viscoelastic material to dissipate energy and thereby reduce vibrations.

In an embodiment of a displacement device, the inward-most tips of the inward-facing projections of the outer rotor are rounded.

Compared to fins with knife-edge seals, round fins are generally easier to fabricate to a given tolerance, provide a longer sealing distance, and allow for higher strength, stiffness and durability than knife-edge seals for a given material. Consequently, the rounded geometry may enable a designer to change the material of a metal part to an alternative material which is less strong, less stiff, and or less durable, for example plastic, for example to lower costs, improve manufacturability, or shift resonance frequencies of the fins.

In an embodiment of a displacement device, the inner rotor further comprises trough sealing zones defining sealing surfaces 1050 at troughs between the outward-facing projections, the trough sealing surfaces 1050 being arranged to seal against the inward-most tips of the projections of the outer rotor as the inward-most tips trace the hypotrochoid paths.

In an embodiment of a displacement device, the inward-most tips of the outer rotor fins are formed of a harder material than that of the trough sealing zones.

Figure 6:
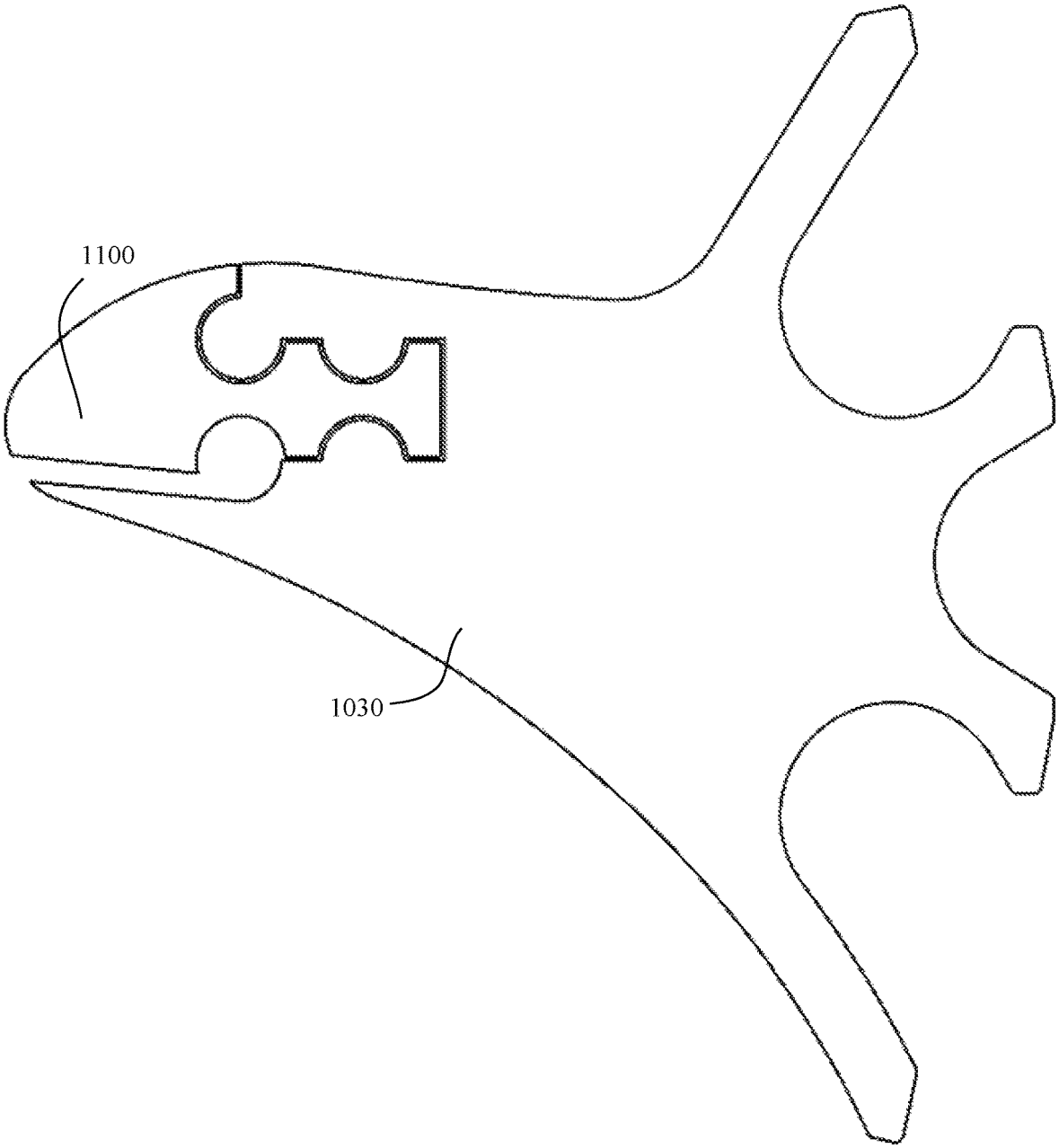
FIG. 6 is a close-up view of an alternate outer rotor fin geometry with a flexible zone along the trailing edge of the outer rotor fin and separate outer rotor fin tip which is assembled together with the rest of the outer rotor fin.
Figure 7:
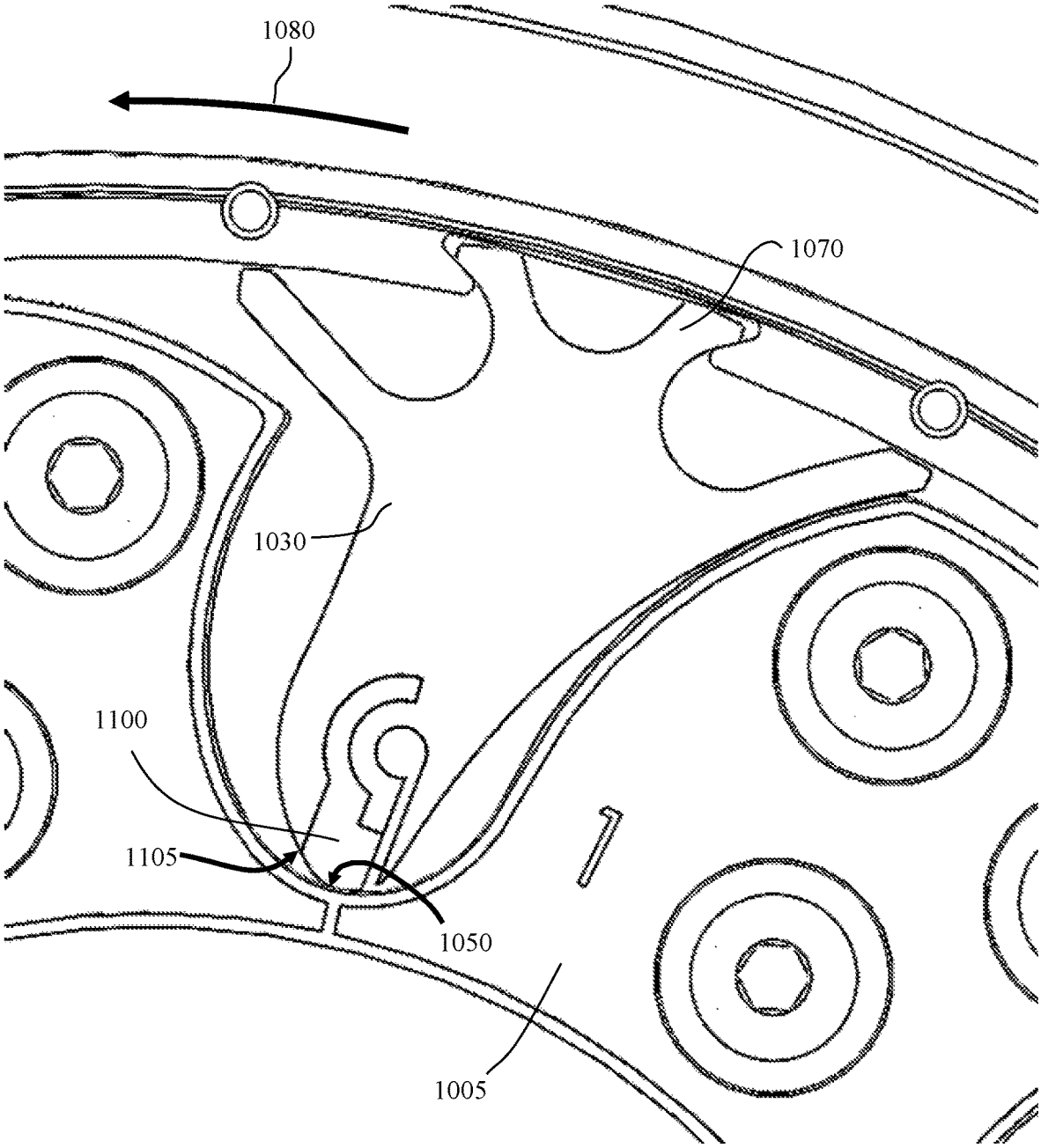
FIG. 7 is a close-up view of another alternate outer rotor fin geometry with a flexible zone along the trailing edge of the outer rotor fin and a separate outer rotor fin tip which is assembled together with the rest of the outer rotor fin.

In an embodiment of a displacement device shown in FIG. 7, the sealing surfaces 1105 of the inner rotor fin 1030 tips are formed of a harder material than the corresponding scaling surfaces 1050 of the inner rotor trough zones. In the embodiment shown in FIG. 6 and FIG. 7, outer rotor fin 1030 has an inner-most tip region 1100 which is a separate part of the outer rotor fin 1030 assembled together with the rest of the fin. In an embodiment, this tip region 1100 is constructed from a material that is harder than that of the corresponding trough sealing zones of the inner rotor 1005.

In an embodiment of a displacement device, the inward-most tips of the outer rotor fins are configured to abrade the trough sealing zones of the inner rotor. A rough surface of the inward-most tips of the outer rotor fins may accomplish this abrading action, for example.

In the embodiment shown in FIG. 7, the sealing surface 1105 of tip region 1100 of the outer rotor fin 1030 is an abrasive surface and comes into contact with the sealing surfaces 1050 of the trough sealing regions of the inner rotor 1005 as the inner rotor and outer rotor rotate together.

In an embodiment of a displacement device, the inward-most tips of the outer rotor fins are formed of a softer material than that of the trough sealing zones.

Figure 8:
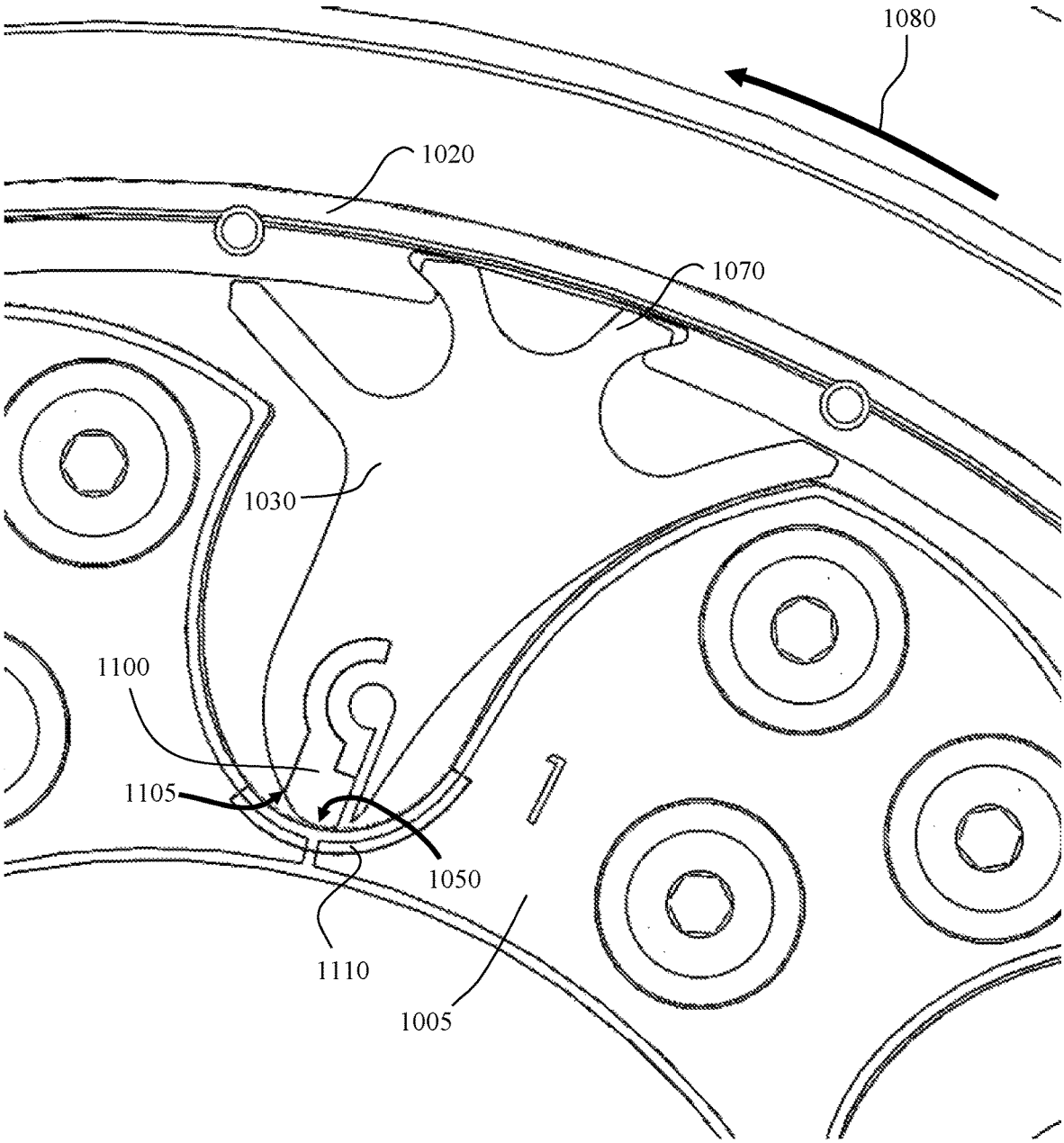
FIG. 8 is a close-up view of a fin of the outer rotor fin geometry shown in FIG. 7 with the trough zone of the inner rotor formed from a separate part assembled together with the rest of the inner rotor.

In an embodiment of a displacement device shown in FIG. 8, the sealing surfaces 1105 of the tip regions 1100 of the fins 1030 of the outer rotor 1020 are formed from a material which is softer than the sealing surfaces 1050 of the inner rotor troughs zones 1110. In an embodiment, the harder material is a metal such as aluminum or steel and the softer material is plastic such as PEEK.

In an embodiment of a displacement device, the inward-most tips of the outer rotor fins are configured to be abraded by the trough sealing zones.

In an embodiment of a displacement device shown in FIG. 8, the sealing surfaces 1105 of the tip regions 1100 of the fins 1030 of the outer rotor 1020 are formed from a material which is abraded by the sealing surfaces 1050 of the inner rotor troughs zones 1110. In an embodiment, the abrasive material is roughened metal such as aluminum or steel and the material to be abraded is plastic such as PEEK.

In an embodiment of a displacement device, the inward-most tips of the outer rotor fins are configured to be abraded by the trough sealing zones. In an embodiment, the trough sealing zones of the inner rotor 1005 are formed from an abrasive material. In the embodiment shown in FIG. 8, the trough zones 1110 including sealing surface 1050 of the inner rotor are designed to be a discrete part to be assembled with the rest of the inner rotor, with the trough sealing surface of the trough sealing zone made from a material which is more abrasive than the majority of the other surfaces of the inner rotor. In an embodiment, the abrasive material is roughened metal such as aluminum or steel and the material to be abraded is plastic such as PEEK.

In an embodiment of a displacement device, the inward-most tips of the outer rotor fins are formed of a softer material than that of the tip sealing zones. In the embodiment of a displacement device shown in FIG. 12, the tip region 1100 of outer rotor fin 1030 including the inward-most tip 1045 is a separate part from the rest of the outer rotor and is formed from a material which is softer than the material of the sealing surface 2325 of a tip sealing zone 2100 of the inner rotor 1005 which is a separate part from the rest of the aforementioned inner rotor. In an embodiment, the softer material is a plastic such as PEEK.

In an embodiment of a displacement device, the tip sealing zones are configured to abrade the inward-most tips. In an embodiment of a displacement device shown in FIG. 12, the sealing surfaces of the tip sealing zones 2100 of the inner rotor 1005 are formed from a material which abrades the inward-most tips 1045 of the outer rotor fin tip regions

1100. In an embodiment, the abrasive material is roughened metal such as aluminum or steel and the material to be abraded is a plastic such as PEEK. This feature may be combined with or separate from the above embodiment in which the inward-most tips are formed of a softer material than the tip sealing zones.

In another embodiment of a displacement device, the inward-most tips of the outer rotor fins are formed of a harder material than that of the trough sealing zones. In this embodiment shown in FIG. 8, the tip regions 1100 of the inward-facing fins 1030 of the outer rotor 1020 are formed from a material which is harder than the material of the sealing surfaces of the trough sealing zones 1110 of the inner rotor troughs. In an embodiment, the harder material is metal such as aluminum or steel.

In another embodiment of a displacement device, the inward-most tips of the outer rotor are configured to abrade the trough sealing zones. In this embodiment, also shown in FIG. 8, the inward-most tips 1045 of the inward-facing fins 1030 of the outer rotor 1020 are formed from a material which abrades the sealing surfaces of the trough sealing zones 1110. In an embodiment, the abrasive material is roughened metal such as aluminum or steel and the material to be abraded is plastic such as PEEK. This embodiment may be combined with or separate from the above embodiment in which the inward-most tips are formed of a harder material than the tip sealing zones.

In an embodiment, the driving surfaces 1035 may be convex. In another embodiment, which may be combined with or independent from the embodiment in which the driving surfaces 1035 are convex, the corresponding driven surfaces of the outer rotor are concave. In the embodiment of the displacement device for example shown in detail in FIG. 2 to FIG. 4, the inner rotor is the driving rotor and the driven surfaces 1040 of the inward-facing outer rotor fins 1030 are concave.

Figure 13:
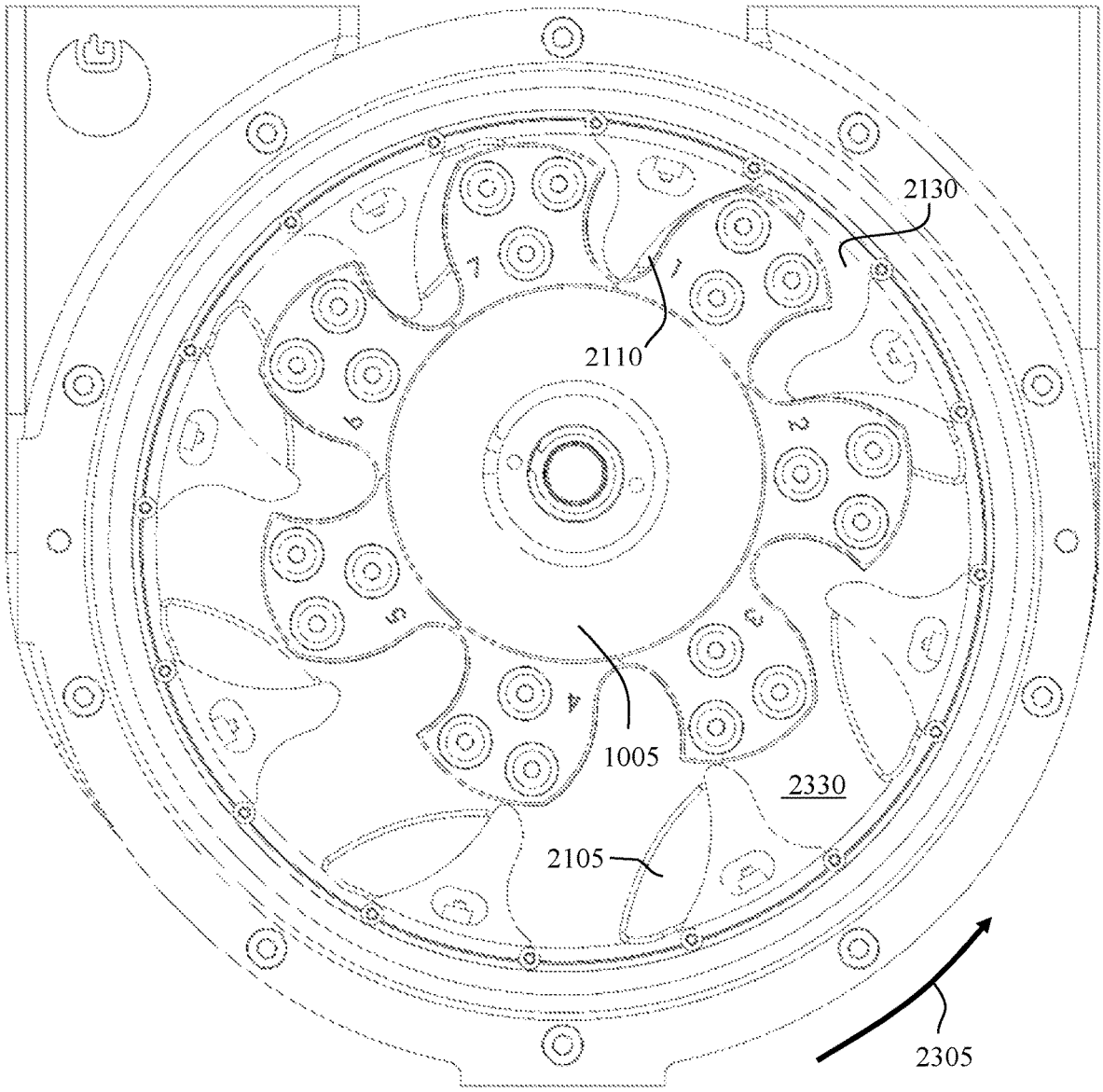
FIG. 13 shows a machine with axial flow channels located on an endplate which prevent sealing of secondary chambers.
Figure 14:
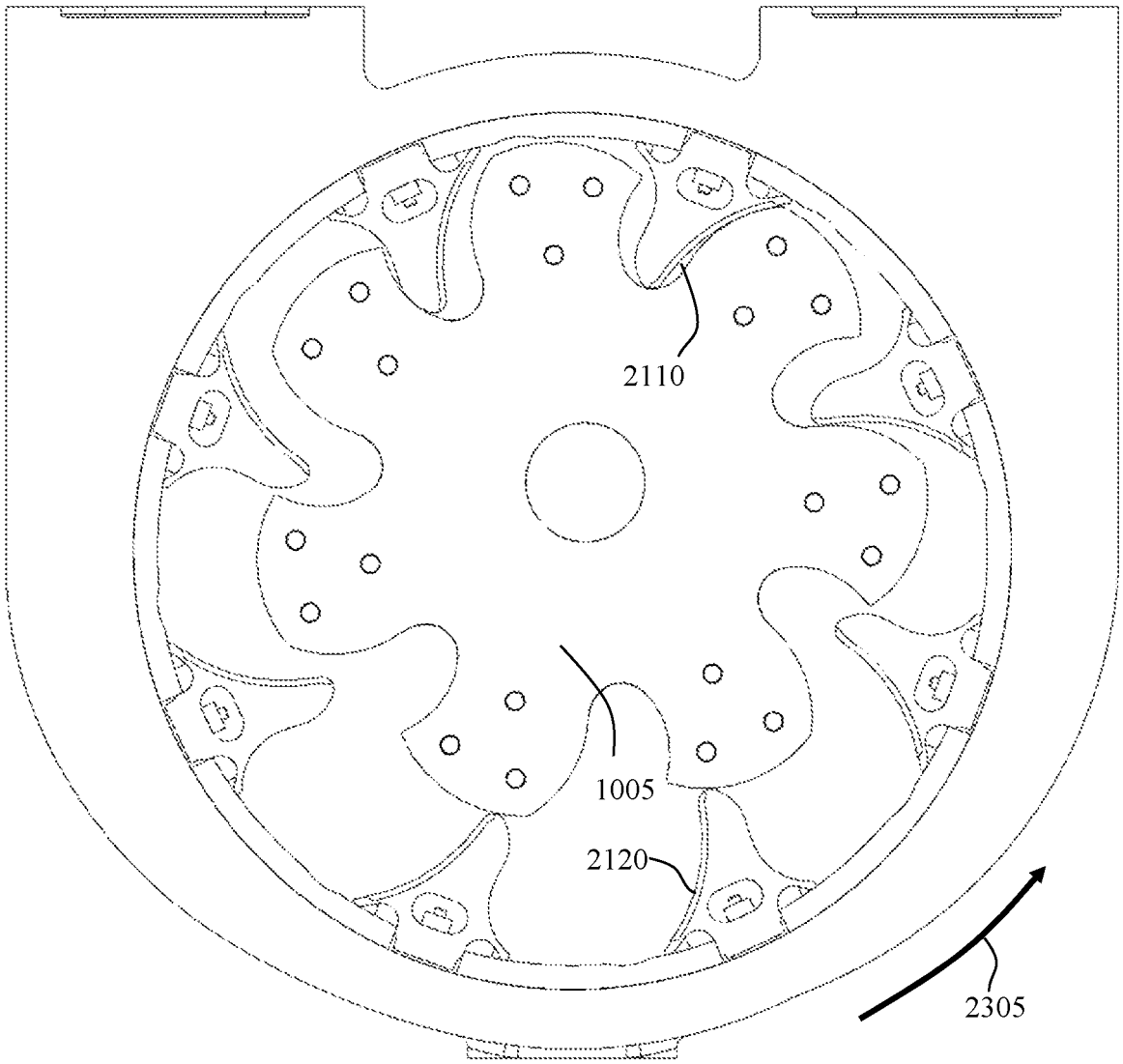
FIG. 14 shows a machine with flow channels located along the outer rotor fins which prevent sealing of secondary chambers.
Figure 15:
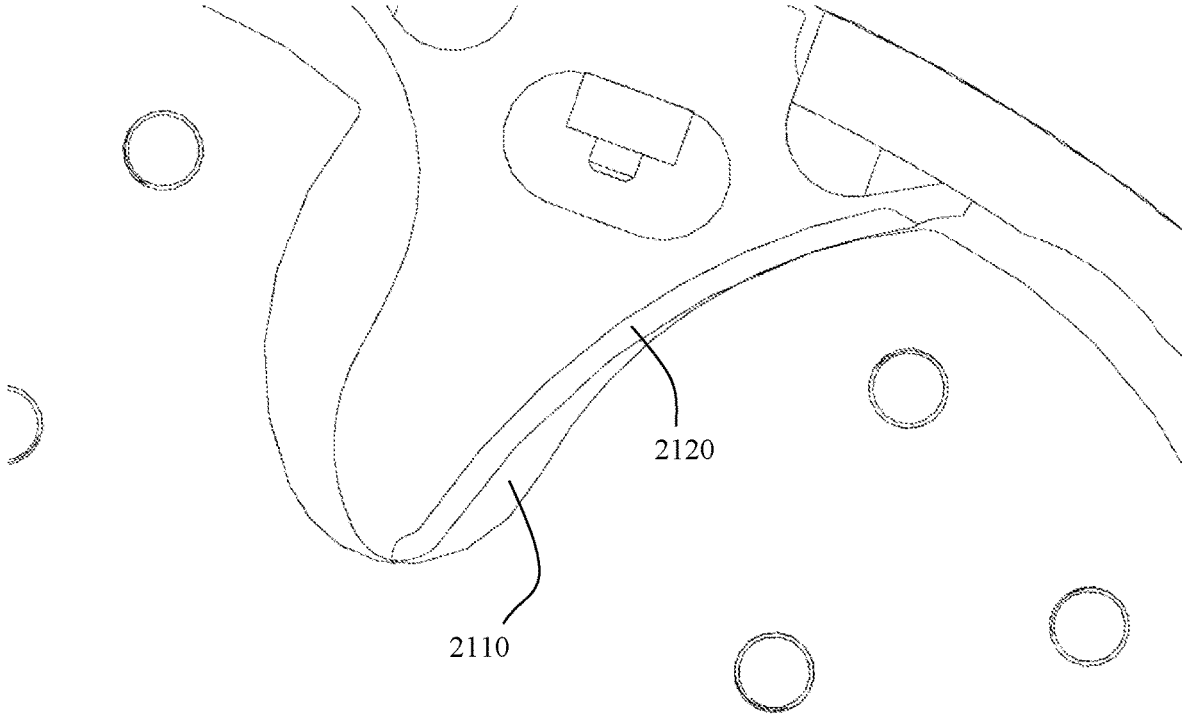
FIG. 15 shows a close-up of the flow channels shown in FIG. 14.
Figure 16:
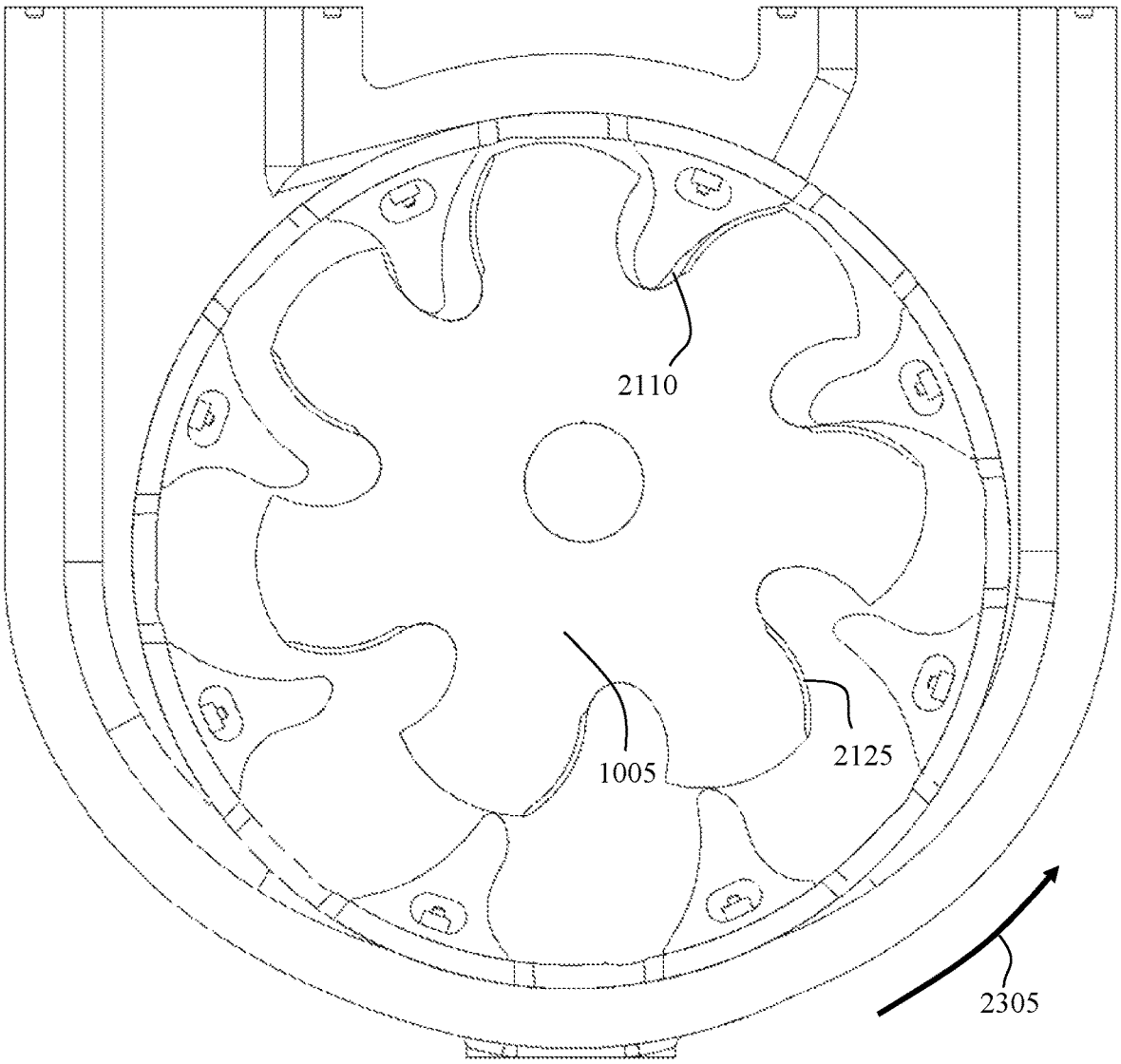
FIG. 16 shows a machine with flow channels located along the inner rotor lobes which prevent sealing of secondary chambers.
Figure 17:
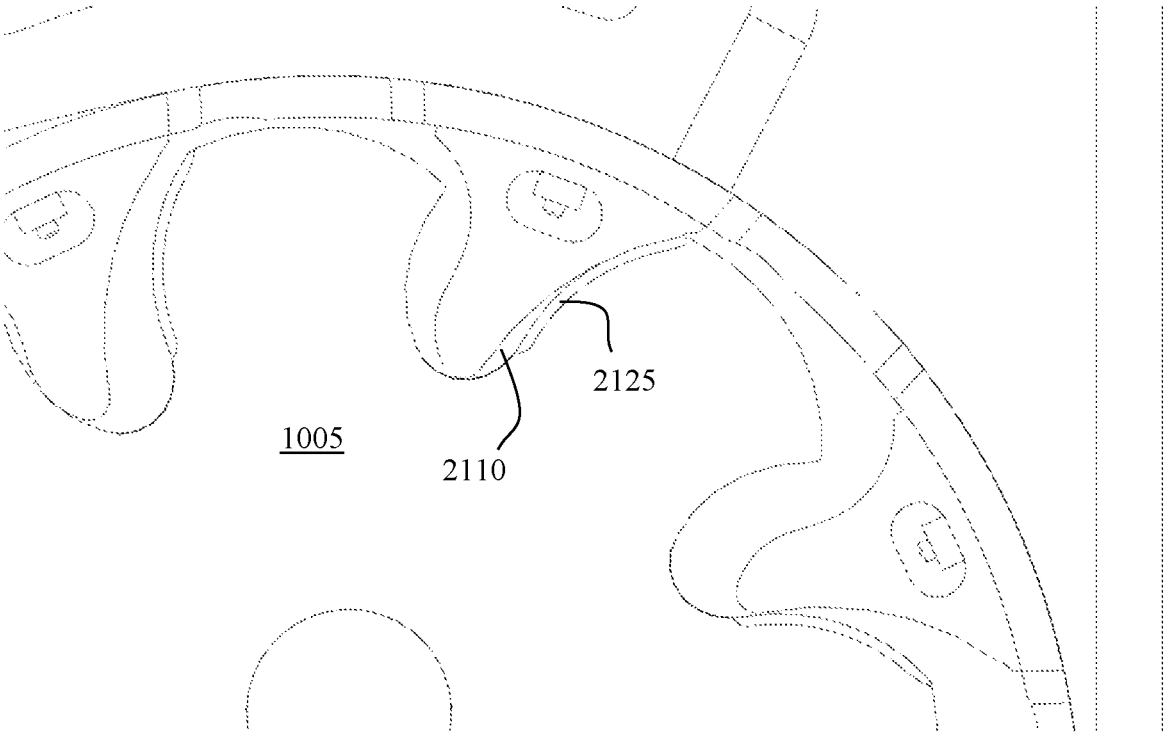
FIG. 17 shows a close-up of the flow channels shown in FIG. 16.

As the leading or trailing edges of the outer rotor projections contact corresponding surfaces of the inner rotor projections, they form primary chambers such as primary chamber 2130 shown in FIG. 13. The curved surfaces of the respective projections may form an additional sealed chamber, referred to here as a secondary chamber 2110, near top dead center, which is the position at which the primary chamber reaches minimum volume. To prevent these secondary chambers from being sealed and thus resulting in wasteful compression or decompression of fluid in that space, in an embodiment, the inner rotor, outer rotor or both define flow channels arranged to prevent the formation of the sealed secondary chamber. The flow channels may be arranged to connect these secondary chambers to an adjacent primary chamber. In example embodiments, flow channels could be located, for example, in an inward facing axial endplate 2330 of the outer rotor as shown by flow channel 2105 in FIG. 13, in the contacting surface of the inward facing projections of the outer rotor as shown by flow channel 2120 in FIG. 14 and in close-up in FIG. 15, or in the outward facing projections of the inner rotor 1005 as shown by flow channel 2125 FIG. 16 and in close-up in FIG. 17, thereby avoiding unnecessary compression of fluid in this volume and therefore avoiding or reducing this energy loss.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The various embodiments described above can be combined to provide further embodiments. All of the patents and publications referred to in this specification and/or listed in the Application Data Sheet are incorporated herein by reference, in their entirety. Aspects of the embodiments can be modified, if necessary to employ concepts of the various patents and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A displacement device comprising:

a housing;

an inner rotor with an outer surface defining an inner rotor projection number of outward-facing projections, the inner rotor being fixed for rotation relative to the housing about a first axis; and an outer rotor with an inner surface defining an outer rotor projection number of inward-facing projections, the outer rotor being fixed for rotation relative to the housing about a second axis parallel to and offset from the first axis;

the inward-facing projections of the outer rotor having inward-most tips defining, during rotation of the inner and outer rotors, hypotrochoid paths relative to the inner rotor;

the outer surface of the inner rotor comprising tip sealing zones at tips of the outward-facing projections, the tip sealing zones being arranged to seal against the inward-most tips of the projections of the outer rotor as the inward-most tips trace the hypotrochoid paths;

the inward-facing projections of the outer rotor intermeshing with the outward-facing projections of the inner rotor, and driving surfaces of the outward-facing projections of the inner rotor contacting corresponding driven surfaces of the inward-facing projections of the outer rotor as the inward-facing projections and the outward-facing projections intermesh to fix a relative ratio of rotation speeds defined by a ratio of the inner rotor projection number to the outer rotor projection number, the inward-facing projections defining respective slots extending from the inner surface of the outer rotor and axially spanning the inward-facing projections to cause respective driven surface flexible zones, of the inner surface at the inward-facing projections and defined by the respective slots, to flex under contact between the inner and outer rotors and the corresponding driven surfaces being formed at least in part on the respective driven surface flexible zones;

in which, in use of the displacement device, contact between the driving surfaces and corresponding driven surfaces moves radially outward from a point of initial contact relative to a direction of rotation of the inner and outer rotors in which the driving surfaces drive the driven surfaces.

2. The displacement device of claim 1 in which the driving surfaces are arranged to flex under contact between the inner and outer rotors.

3. The displacement device of claim 2 in which the outward-facing projections of the inner rotor are formed of steel and the inward-facing projections of the outer rotor are formed of a material having an elastic modulus of less than 150 GPa.

4. The displacement device of claim 3 in which the inward-facing projections of the outer rotor comprise damping material.

5. The displacement device of claim 2 in which the driving surfaces are formed at least in part on driving surface flexible zones.

6. The displacement device of claim 1 in which the respective slots separate the respective driven surface flexible zones from the inward-most tip, of the inward-most tips, of a respective inward-facing projection of the inward-facing projections of the outer rotor by the slot in the respective inward-facing projection of the outer rotor.

7. The displacement device of claim 1 in which the respective slots each extend from a leading face of a respective inward-facing projection of the outer rotor so that the respective driven surface flexible zones include the inward-most tips of the respective inward-facing projection of the outer rotor.

8. The displacement device of claim 1 in which the inward-facing projections of the outer rotor are connected to a main body of the outer rotor using fasteners.

9. The displacement device of claim 1 in which the inward-most tips of the inward-facing projections of the outer rotor are rounded.

10. The displacement device of claim 1 in which the inner rotor further comprises trough sealing zones at troughs between the outward-facing projections, the trough sealing zones being arranged to seal against the inward-most tips of the inward-facing projections of the outer rotor as the inward-most tips trace the hypotrochoid paths.

11. The displacement device of claim 10 in which the inward-most tips of the inward-facing projections of the outer rotor are constructed from a harder material than the inner rotor at the trough sealing zones.

12. The displacement device of claim 10 in which the inward-most tips of the inward-facing projections of the outer rotor are configured to abrade the inner rotor at the trough sealing zones.

13. The displacement device of claim 10 in which the inward-most tips of the inward-facing projections of the outer rotor are formed of a softer material than the inner rotor at the trough sealing zones.

14. The displacement device of claim 10 in which the inward-most tips of the inward-facing projections of the outer rotor are configured to be abraded by the inner rotor at the trough sealing zones.

15. The displacement device of claim 10 in which the inner rotor at the trough sealing zones is configured to abrade the inward-most tips of the inward-facing projections of the outer rotor.

16. The displacement device of claim 1 in which the inward-most tips of the inward-facing projections of the outer rotor are formed of a softer material than the inner rotor at the tip sealing zones.

17. The displacement device of claim 1 in which the inner rotor at the tip sealing zones is configured to abrade the inward-most tips of the inward-facing projections of the outer rotor.

18. The displacement device of claim 1 in which the inward-most tips of the inward-facing projections of the outer rotor are formed of a harder material than the inner rotor at the tip sealing zones.

19. The displacement device of claim 1 in which the inward-most tips of the inward-facing projections of the outer rotor are configured to abrade the inner rotor at the tip sealing zones.

20. The displacement device of claim 1 in which the corresponding driven surfaces of the outer rotor are concave.

21. The displacement device of claim 1 in which the driving surfaces of the inner rotor are convex.

22. The displacement device of claim 1 in which the inner rotor, outer rotor, or both, define flow channels arranged to prevent a formation of a sealed secondary chamber between the outward-facing projections of the inner rotor and the inward-facing projections of the outer rotor at or near Top Dead Center (TDC).

* * * * *